US005090060A

United States Patent [19]

Gates

[11] Patent Number: 5,090,060

[45] Date of Patent: Feb. 25, 1992

[54] SPORT SHIFT SLEEVES HAVING PERSPIRATION ABSORBING ELEMENTS

[76] Inventor: Victor G. Gates, 1007 20th St., Apt. 9, Santa Monica, Calif. 90401

[21] Appl. No.: 130,762

[22] Filed: Dec. 9, 1987

[51] Int. Cl.[5] ..... A41B 1/08

[52] U.S. Cl. ..... 2/115; 2/125

[58] Field of Search ..... 2/125, 59, 77, 115, 2/79, 51, 48, DIG. 6, 83, 75, 80, 49

[56] References Cited

U.S. PATENT DOCUMENTS

| | | | |
|---|---|---|---|
| 1,287,691 | 12/1918 | Hogan | 2/59 |
| 2,021,714 | 11/1935 | Cole | 2/115 |
| 2,674,738 | 4/1954 | Memlos | 2/48 |
| 2,922,164 | 1/1960 | Liff | 2/49 R |
| 3,174,156 | 3/1965 | Dale et al. | 2/115 |
| 4,050,099 | 9/1977 | David | 2/49 |
| 4,249,268 | 2/1981 | Berler . | |
| 4,304,006 | 12/1981 | Swart | 2/80 |
| 4,603,440 | 8/1986 | Hale | 2/115 |
| 4,768,236 | 9/1988 | Klab | 2/238 |

*Primary Examiner*—Werner H. Schroeder
*Attorney, Agent, or Firm*—W. Edward Johansen

[57] ABSTRACT

The present invention is an improved sport shirt which an individual wears during his work, recreational or athletic activities. The improved sport shift includes a front fabric panel, a rear fabric panel and a pair of sleeves. Each front and rear fabric panel has edge portions which define a pair of sleeve holes near one end thereof. Each sleeve is formed from a lightweight stretch material and is secured to one of the sleeve holes. The improved sport shirt also includes a pair of perspiration-absorbing elements each of which is mechanically coupled to one of the sleeves. The individual may utilize one of the perspiration-absorbing elements to conveniently wipe moisture from his face and forehead.

1 Claim, 1 Drawing Sheet

SPORT SHIFT SLEEVES HAVING PERSPIRATION ABSORBING ELEMENTS

BACKGROUND OF THE INVENTION

1. Field of the Invention

The present invention relates to a sport shirt which an individual wears during his work, recreational or athletic activities and more particularly to a sport shirt with sleeves having perspiration-absorbing elements so that the individual may conveniently wipe moisture from his face and forehead.

2. Description of the Prior Art

U.S. Pat. No. 3,137,860, entitled Sport Shirts, issued to Ben Bindler on June 23, 1964, teaches a sport shirt which includes front and rear fabric panels. The front and rear panels have edge portions which define sleeve holes near one end thereof. A pair of endless elastic bands are secured at one edge thereof to the sleeve hole defining edge portions. Each of the elastic bands has an elongated integral elastic extension. The front and rear panels have lateral edges which are secured to opposite edges of the extension which extend to the other end of the front and rear panels. Sleeves are secured to outer edges of the elastic bands. Further elastic bands are inset in the rear panel closely spaced from and extending parallel to portions of the endless bands.

U.S. Pat. No. 4,603,440, entitled Sport jersey, issued to James M. Hale on Aug. 5, 1986, teaches a sport jersey for motorcycle racing having perspiration and cooling cuffs which are attached to the ends of the sleeves. The inner faces of the cuffs are made from an absorbent uncut pile such as terry cloth. The outer faces of the cuffs are formed from a ribbed backing material.

U.S. Pat. No. 2,021,714, entitled Garment, issued to Florence R. Cole on Nov. 19, 1935, teaches a shirt which includes a body portion with a central neck opening and a pair of sleeves. The shirt is made out of flannel which is a heat retaining material. The shirt incorporates a double thickness of flannel to protect the upper part of the trunk of the wearer's body against cold.

U.S. Pat. No. 4,249,268, entitled Garment Composed of Non-stretchable Body Portion Entirely Covered by Loop Fasteners and Stretchable Portion Not So Covered, issued to Herbert Berler on Feb. 10, 1981, teaches garment which is composed of a non-stretchable body portion entirely covered by loop fasteners and a stretchable portion not so covered. Ornaments may be attached to the loop fasteners.

U.S. Pat. No. 2,922,164, issued to May W. Liff on Jan. 26, 1960, teaches a shirt for an infant which is made out of tufted terry cloth. The shirt has a moisture-proof front section which is covered by a plastic sheet and a front panel which is detachably coupled to the front section. The front panel can be laundered separately from the shirt.

U.S. Pat. No. 2,674,738, entitled Feeding Garment, issued to Ralph A. Mehlos on Apr. 14, 1954, teaches a garment which is one piece of soft absorbent material such as terry cloth. The garment can be worn by a peson who is feeding a baby in order to protect her clothing.

U.S. Pat. No. 4,304,006, entitled Coverall Garment for Toddlers, issued to Klara Swart on Dec. 8, 1981, teaches a coverall garment which is one piece and disposable. The coverall garment is for use by toddlers.

U.S. Pat. No. 4,768,236, entitled Sportswear Having Detachable Towelling Means, issued to Terry A. Klob on Sept. 6, 1988, teaches a sportswear which has readily accessible towelling means which are detachably and invisibly anchored to either the waistband of tennis shorts or the sleeves of a tennis shirt.

U.S. Pat. No. 3,174,156, entitled Sport Shirt, issued to David B. Dale and William E. Hervey on Mar. 3, 1965, teaches a sport shirt which includes a body portion above the waistline and a hand wiping unit having a hand-contacting portion of moisture absorbing material secured to the shirt body portion. The hand wiping unit is in the form of a fingered glove and has a hand back-engaging portion and a palm-engaging portion. A portion of the hand-contacting portion which includes the palm-engaging portion is loosely supported from the shirt body portion to permit clenching of the palm-engaging portion in the hand of the user.

U.S. Pat. No. 4,541,129, entitled Sweat Absorbent Undershirt issued to Hideo Murakami on Sept. 17, 1985, teaches a sweat absorbent undershirt which is adapted to be used as an undershirt for sportwares which sport players generally put on when they play golf and tennis. By wearing this sweat absorbent undershirt next to their skin, the skin is prevented from being all covered in sweat however profuse perspiration they get in while playing. The sweat absorbent undershirt is provided with a high degree of sweat absorptive clothing. The sweat remains held thereby to permit players to play free from feeling uncomfortable with sweat which otherwise they might do. The sweat absorbent undershirt includes a pair of open arm portions, an open neck portion, and a body portion having a top part and a bottom part. The top part of the body portion is connected to the pair of arm portions and the neck portion and includes a pile napped sweat absorbent cloth which is disposed on the inside of the undershirt and exposed to the body of a wearer. The pile napped cloth includes a first panel which is disposed completely around the bottom part of the body portion. A second panel is disposed completely around the open neck portion. A plurality of third panels is disposed between the top part and the bottom part with space between each of the third panels. Each third panel is disposed only partially around the body portion and at least one vertical panel connects the first panel, second panel and plurality of third panels. A mesh netting cotton cloth is connected to at least each of the panels of the pile napped cloth. The panels absorb seat of the wearer and the first panel prevents sweat from dropping below the bottom part of the undershirt.

U.S. Pat. No. 4,470,156, entitled Trousers for Athletic Wear and Other Uses, issued to Guy K. Duerbeck and Jean S. Duerbeck on Sept. 11, 1984, teaches a pair of trousers for athletic, casual or outdoor wear. These trousers are resistant to wear, but also have the flexibility and perspiration absorbency which are desirable in an athletic garment. A front section and seat section which are made from denim or some other durable fabric are fixed below a waist band section to cover a wearer's lower torso. A pair of leg sections made from sweat shirt fleece or some other suitable flexible material extends downwardly from these frontal and seat sections Preferably, these leg sections will also be upwardly and frontally reinforced over the wearer's thigh with denim or some other durable material.

U.S. Pat. No. 4,449,252, entitled Protective Garment for a Bowler, issued to Joann J. Sullinger on May 22, 1984, teaches a protective garment for a bowler is described including a generally rectangular towel member having upper and lower ends adapted to be positioned over one of the bowler's breasts and generally extending from the bowler's shoulder to the bowler's waist. A first elongated strap member is secured at one end to the rectangular member above the lower end and is adapted to be extended around the bowler's waist and detachably secured at its other end to the rectangular member. A second elongated strap member is secured at one end to the upper end of the rectangular member and is adapted to extend over the bowler's shoulder and thence downwardly for connection, at its other end, to the first strap member intermediate the ends thereof. The rectangular towel member prevents dirt or the like carried by the bowling ball from being transmitted to the bowler's shirt beneath the rectangular towel member.

U.S. Pat. No. 4,498,200, entitled Garment Having Concealed Pouch, issued to Jeanne Livingstone on Feb. 12, 1985, teaches a garment pouch for retaining and concealing small personal valuables. One or more concealed hemline pockets are provided in an undergarment shirt or blouse, the upper edges of which preferably lie adjacent the hemline. The closure for the pocket, which is co-extensive with stitching above the selvage and the lower edge of the pocket, includes the selvage itself. The closure or closures for the pockets are in-line with the hem stitching line, defining a continuity thereof. If one closure is provided, it may function to close two or more adjacent pockets or pouches in the hem, the pockets being devisable from each other by vertical stitching from hemline to selvage. The pockets may be made easily accessible from either the exterior or interior of the garment and may also be adapted to sportswear having the undergarment as an integral part of the whole, for example, as in golf skirts, tennis and swimwear having outerskirt and inner pants. The wearer of the garment pouch need not undress to retrieve the valuables quickly and easily from any of the garment pocket locations.

SUMMARY OF THE INVENTION

In view of the foregoing factors and conditions which are characteristic of the prior art it is the primary object of the present invention to provide a sport shirt with sleeves having perspiration-absorbing elements so that an individual may conveniently wipe moisture from his face or forehead which the individual wears during his work, recreational or athletic activities.

In accordance with the present invention an embodiment of an improved sport shirt which, an individual wears during his work, recreational or athletic activities is described. The improved sport shirt includes a front fabric panel, a rear fabric panel and a pair of sleeves. Each front and rear fabric panel has edge portions which define a pair of sleeve holes near one end thereof. Each sleeve is formed from a lightweight stretch material and is secured to one of the sleeve holes. The improved sport shirt also includes a pair of perspiration-absorbing elements each of which is mechanically coupled to one of the sleeves. The individual may utilize one of the perspiration-absorbing elements to conveniently wipe moisture from his face and forehead.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
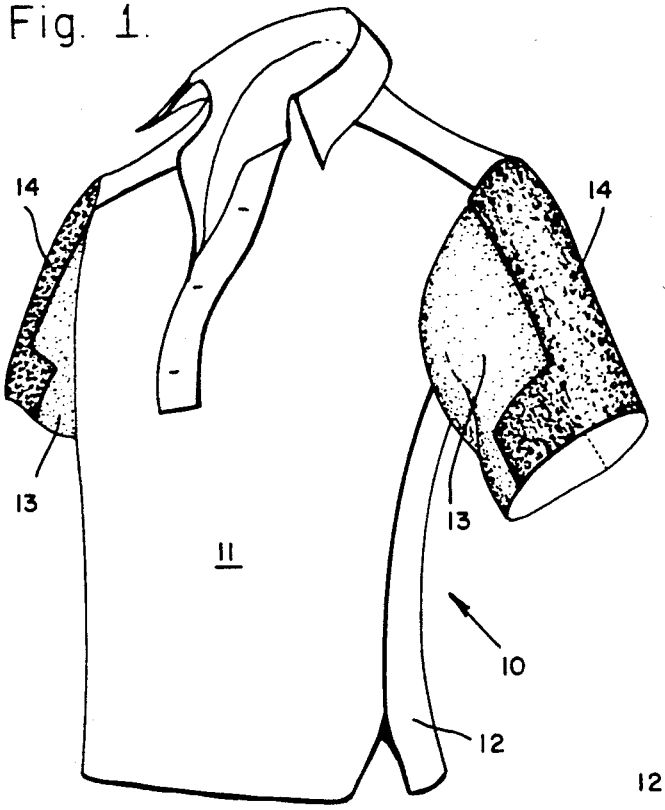
FIG. 1 is a perspective view of a first which has been constructed in accordance with the principles of the first embodiment of the present invention.
Figure 2:
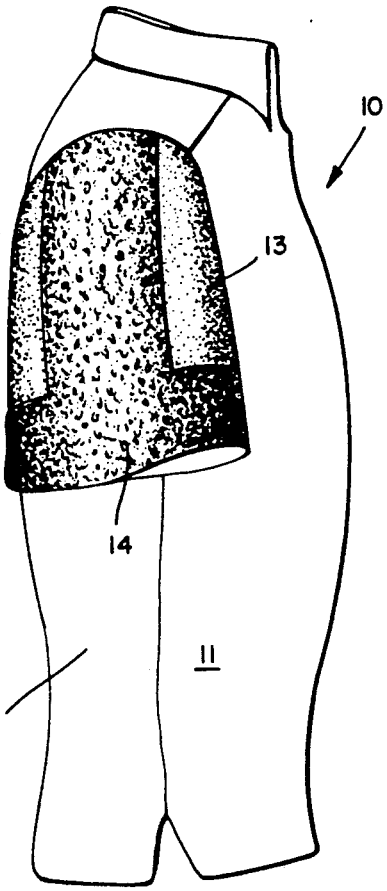
FIG. 2 is a sideview of the sleeve construction.
Figure 3:
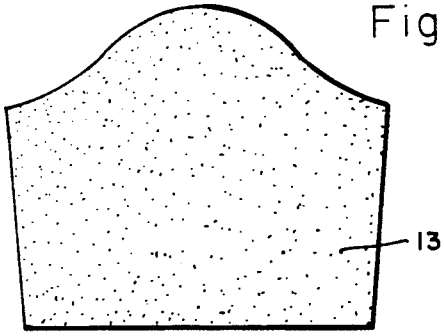
FIGS. 3–5 show details of the sleeve construction.

In order to best understand the present invention it is necessary to refer to the following descriptipn of its preferred embodiment in conjunction with the accompanying drawing. Referring to FIG. 1 in conjunction with FIG. 2 and FIG. 3 an improved sport shirt 10 which an individual wears during his work, recreational or athletic activities includes a front fabric panel 11, a rear fabric panel 12 and a pair of sleeves 13. Each front and rear fabric panel 11 and 12 has edge portions which define a pair of sleeve holes near one end thereof. Each sleeve 13 is formed from a lightweight stretch material and is secured to one of the sleeve holes.

Figure 4:
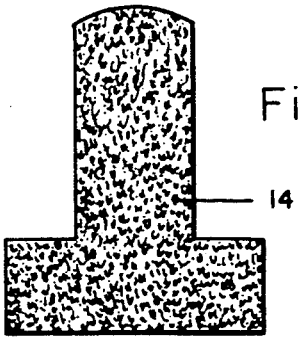
Figure 5:
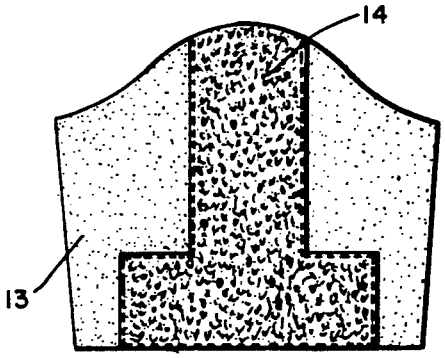

Referring to FIG. 1 in conjunction with FIG. 4 and FIG. 5 the improved sport shirt 10 also includes a pair of perspiration-absorbing elements 14. Each perspiration-absorbing elements 14 is formed from a lightweight, absorbent material, such as terry cloth, and is mechanically coupled to one of the sleeves 13. The individual may utilize one of the perspiration-absorbing elements to conveniently wipe moisture from his face and forehead.

From the foregoing it can be seen that an improved sport shirt with sleeves having perspiration-absorbing elements has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. An improved sport shirt which an individual wears during his work, recreational or athletic activities, said improved sport shirt comprising:

a. a front panel and a rear panel each of which is formed from a moisture-absorbing fabric material and each of which has edge portions which define a pair of sleeve holes near one end thereof;

b. a pair of sleeves each of which is formed from a lightweight stretch fabric material and is secured to one of said sleeve holes; and c. a pair of perspiration-absorbing elements each of which is formed from a moisture-absorbing fabric material and each of which is fixedly coupled to one of said sleeves whereby the individual utilizes one of said perspiration-absorbing elements to conveniently wipe perspiration from his face and forehead.

* * * * *